United States Patent [19]

Proctor

[11] 4,017,864

[45] Apr. 12, 1977

[54] MODE-LAUNCHER FOR SIMULATED WAVEGUIDE

[75] Inventor: David Proctor, San Diego, Calif.

[73] Assignee: The United States of America as represented by the Secretary of the Navy, Washington, D.C.

[22] Filed: July 17, 1975

[21] Appl. No.: 596,930

Related U.S. Application Data

[63] Continuation-in-part of Ser. No. 585,142, June 9, 1975.

[52] U.S. Cl. ..... 343/767; 333/21 R

[51] Int. Cl.[2] ..... H01Q 13/10

[58] Field of Search ..... 343/767, 768, 789; 333/21 R

[56] References Cited

UNITED STATES PATENTS

| | | | |
|---|---|---|---|
| 3,210,694 | 10/1965 | Ehlers | 343/789 |
| 3,262,119 | 7/1966 | Sisson | 343/789 |
| 3,375,474 | 3/1968 | Thompson et al. | 333/21 R |

*Primary Examiner*—Eli Lieberman

*Attorney, Agent, or Firm*—R. S. Sciascia; G. J. Rubens; H. Fendelman

[57] ABSTRACT

A mode-launcher, waveguide antenna element providing signal transition from a principal coaxial TEM-mode to a dominant $TE_{01}$-mode of a rectangular waveguide. A triangular element integrally formed with the waveguide structure and whose plane is normal to the magnetic field of the waveguide is disposed intermediate the frontwall radiating slot of the waveguide and the waveguide backwall through which the coaxial connector probe is introduced.

8 Claims, 3 Drawing Figures

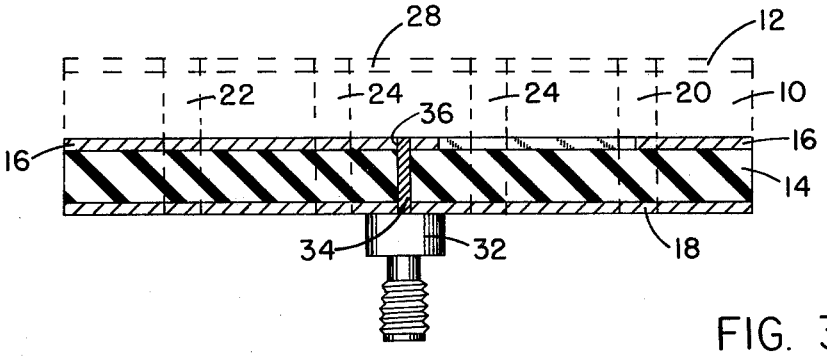
FIG. 3
FIG. 1
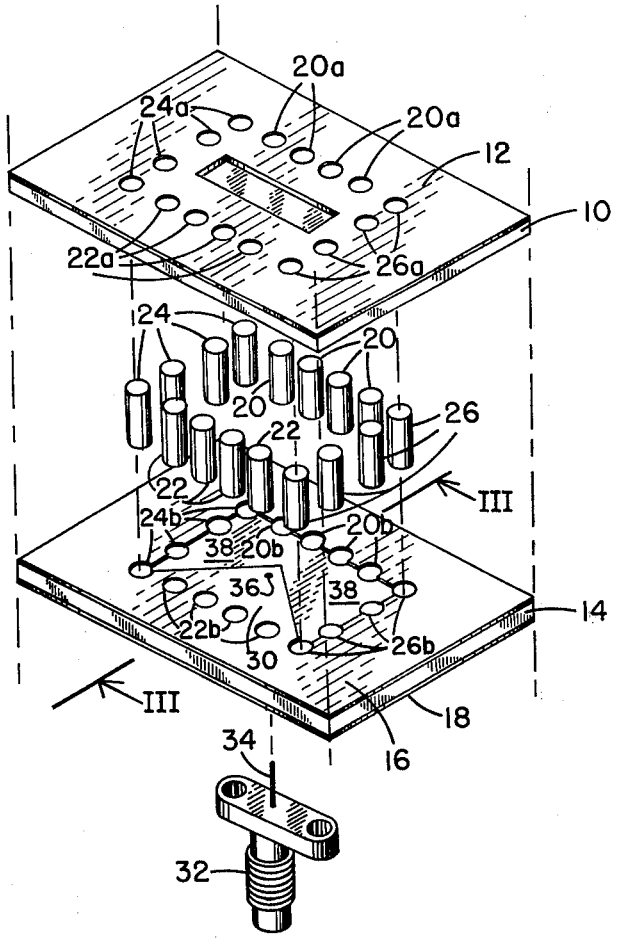
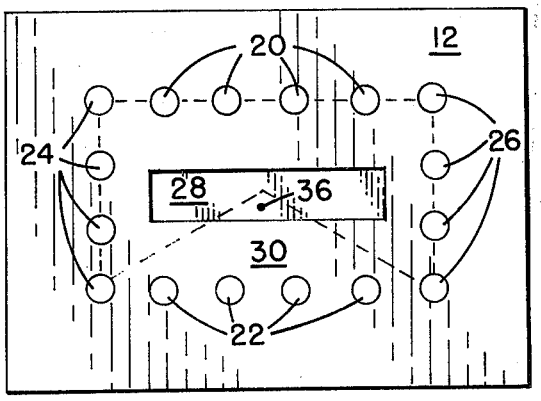
FIG. 2

MODE-LAUNCHER FOR SIMULATED WAVEGUIDE

CROSS REFERENCE TO RELATED APPLICATIONS

This application is a continuation-in-part of application Ser. No. 585,142 filed June 9, 1975 in the name of the present inventor.

BACKGROUND OF THE INVENTION

In microwave transmission lines, it is frequently desirable and often necessary to change from waveguide to coaxial line. The problem is to provide for a transition between the principal coaxial TEM-mode and the dominant $TE_{01}$-mode in the rectangular guide.

The fundamental way of establishing a desired mode in a waveguide is the excitation of either the electric or the magnetic field identified with that mode. This usually is done either by means of an antenna element parallel to the electric field or by means of a loop, the plane of which is normal to the magnetic field.

As disclosed in co-pending application Ser. No. 585,142, a plurality of conducting rods may be used to interconnect the clad surfaces of a metal-clad dielectric and to thereby define the side and backwalls of a dielectric filled waveguide. Similarly, the metallic surfaces of the metal-clad dielectric may be oriented such that they define the front and rearwalls of the dielectric filled waveguide and the conducting rods may be placed so that they define the top, bottom and sidewalls of the waveguide. With this latter type of construction, however, the distance between the dielectric filled waveguide front and backwalls is so small that it precludes coupling into the waveguide by normal methods.

SUMMARY OF THE INVENTION

The present invention relates generally to a mode-launcher that is particularly useful for coupling into a waveguide that is extremely short and in which it is advantageous to couple into the waveguide through the waveguide backwall and more particularly to a mode-launcher integrally formed with a waveguide. The mode-launcher consists of a triangular element whose plane is normal to the magnetic field of the $TE_{01}$-mode and thus excites that mode and provides a transition from the coaxial mode of the input coupler to the waveguide mode. Due to the minimal space requirements of the antenna element and mode-launcher of the present invention, antenna arrays of greatly reduced size and weight may be constructed and utilized.

OBJECTS OF THE INVENTION

It is the primary object of the present invention to disclose a mode-launcher that is particularly useful with short length waveguides due to its minimal space requirements.

It is another object of the present invention to disclose a mode-launcher particularly useful for waveguides requiring coupling through the backwall thereof and particularly suitable for dielectric filled waveguides.

It is a further object of the present invention to disclose a mode-launcher formed integrally with a waveguide structure which is thereby extremely simple to manufacture.

Other objects, advantages and novel features of the invention will become apparent from the following detailed description of the invention when considered in conjunction with the accompanying drawings.

BRIEF DESCRIPTION OF THE DRAWINGS

FIG. 1 is an exploded view of the combination mode-launcher and waveguide antenna element of the present invention.

FIG. 2 is a front view of the mode-launcher, waveguide antenna element of the present invention.

FIG. 3 is a sectional side view of the mode-launcher, waveguide antenna element of the present invention taken along the plane III—III of FIG. 1.

DESCRIPTION OF THE PREFERRED EMBODIMENTS

The type of waveguide for which the mode-launcher of the present invention is particularly adapted is disclosed in detail in copending patent application Ser. No. 585,142 which discloses the concept of forming waveguide walls with a plurality of conducting rods which interconnect opposing conducting surfaces of metal-clad dielectric boards. As is disclosed therein, the pins define the back and sidewalls of the waveguide and the antenna element radiates out of a slot defined by the opposing metal surfaces. As is illustrated in FIG. 1 herein the conducting pins can also be used to define the top, bottom and sidewalls of the waveguide. The opposing conducting metal surfaces comprise the front and backwalls of the waveguide and the frontwall conducting surface is etched away within the enclosure formed by the conducting pins to provide a radiating slot.

The mode-launcher, waveguide antenna element according to the present invention is illustrated in FIGS. 1, 2 and 3. A first sheet of insulating dielectric 10 is bonded on one side by a suitable metal 12 such as copper. A second sheet of insulating dielectric 14 similarly is bonded on the interior side by a sheet 16 of metal and on the exterior side by a sheet 18 of metal both of which may also be copper. A first row of conducting rods 20 electrically and mechanically connects metallic sheet 12 to metallic sheet 18 and extends through apertures **20*a* and 20*b* as illustrated. A second row of conducting rods 22 parallel to the row of rods 20 also mechanically and electrically interconnects conductive sheets 12 and 18 through apertures 22*a* and 22*b* as illustrated. Third and fourth parallel rows of conducting rods 24 and 26 similarly interconnect metallic sheets 12 and 18 through apertures 24*a*, 24*b*, 26*a* and 26*b* respectively. The rows of conducting rods 20 and 22 thus define the top and bottom walls respectively of a dielectric filled waveguide. The sidewalls are similarly defined by the conducting rods 24 and 26. A radiating slot 28** is provided by removing a rectangular portion of the metallic sheet by any suitable process such as, for example, photo etching techniques.

This type of antenna element construction precludes coupling into the waveguide by normal methods since the distance between the backwall defined by conducting surface 18 and the frontwall radiating surface 28 is so small, typically a fraction of an inch. The transition from the principal coaxial TEM-mode of propagation in the coaxial line is effectuated by the triangular element 30. Coaxial connector 32 is secured by suitable means (not shown) to the backwall defined by conducting surface 18 of the waveguide. The inner conductor 34 of the coaxial connector 32 extends through the backwall 18 and the dielectric 14 and is mechanically and electrically connected to the triangular element 30 at the apex 36 of the triangle. The triangular element 30 is most easily formed as an integral part of the conducting surface 16. Photo etching or any other suitable technique can be used to remove the portions of conductive surface 16 in the areas 38 such that triangle 30 is thereby defined. The bottom leg of the triangle 30 is thereby grounded to the bottom wall of the waveguide defined by the row of conducting rods 22. The vertex 36 of the triangle 30 is positioned at the center of the rectangular waveguide, i.e., at the point that is midway between the sidewalls and midway between the top and bottom walls of the waveguide. It has been found that the most efficient operation is achieved when the length of one of the sides of the triangle 30 adjacent the apex 36 plus the length of that portion of the coaxial connector inner conductor 34 extending between the conducting surface 18 and the triangular element 30 is approximately $\lambda/4$ where $\lambda$ is the operating wavelength of the device within the dielectric at midband frequency. Since the plane of the triangular element 30 is normal to the magnetic field of the $TE_{01}$-mode, it thus excites that mode and provides a transition from the coaxial mode of the input coupler to the waveguide mode.

Obviously many modifications and variations of the present invention are possible in the light of the above teachings. It is therefore to be understood that within the scope of the appended claims the invention may be practiced otherwise than as specifically described.

What is claimed is:

1. In a coaxial to waveguide transition assembly including a coaxial connector having an inner conductor and an outer conductor, a waveguide having a conducting backwall electrically and mechanically connected to said coaxial connector outer conductor, said waveguide having top and bottom walls, sidewalls and a frontwall radiating slot, the improvement comprising:

a triangular conducting element having an apex and first and second vertices, said element being disposed intermediate said conducting backwall and said frontwall radiating slot, said element being electrically connected to said coaxial connector inner conductor.

2. The assembly of claim 1 in which the plane of said element is parallel to the plane of said conducting backwall.

3. The assembly of claim 2 in which said coaxial connector inner conductor is electrically connected to said element at the apex of said loop.

4. The assembly of claim 3 wherein the apex of said element is located midway between said top and bottom walls and midway between said sidewalls.

5. The assembly of claim 4 wherein said first and second vertices are grounded to said bottom wall.

6. The assembly of claim 5 wherein said waveguide top and bottom walls and said waveguide sidewalls are comprised of a plurality of conducting rods.

7. The combination of a waveguide and mode-launcher comprising:

a first sheet of dielectric having a first conductive surface bonded on one side thereof;

a second sheet of dielectric juxtapose to said first sheet of dielectric having second and third conductive surfaces bonded on first and second sides respectively thereof;

a plurality of conductive rods electrically interconnecting said first and third conductive surfaces and defining the top, bottom and sidewalls of a dielectric filled rectangular waveguide;

said second conductive surface having a triangular shaped portion extending into the interior of said rectangular waveguide; and a radiating slot provided in said first conductive surface.

8. The combination of claim 7 wherein the apex of said triangular shaped portion is approximately midway between said top and bottom walls and midway between said sidewalls.

* * * * *